US005654725A

United States Patent [19]

Kozlovski et al.

[11] Patent Number: 5,654,725

[45] Date of Patent: Aug. 5, 1997

[54] ULTRA-FLEXIBLE DIPOLE ANTENNA

[75] Inventors: Albert David Kozlovski, Atkinson; Wayne Bickford, Epping, both of N.H.

[73] Assignee: The Whitaker Corporation, Wilmington, Del.

[21] Appl. No.: 604,755

[22] Filed: Feb. 23, 1996

[51] Int. Cl.[6] ..... H01Q 9/16

[52] U.S. Cl. ..... 343/792; 343/802

[58] Field of Search ..... 343/790–792, 343/905, 906, 749, 715, 900, 901, 802; 174/158 A; H01Q 1/24, 9/00, 9/16

[56] References Cited

U.S. PATENT DOCUMENTS

| | | | |
|---|---|---|---|
| 2,492,404 | 12/1949 | Streib et al. | 29/155.5 |
| 3,932,873 | 1/1976 | Garcia | 342/792 |
| 4,180,819 | 12/1979 | Nakano | 343/792 |
| 4,204,213 | 5/1980 | Wheeler et al. | 343/706 |
| 4,205,319 | 5/1980 | Gasparaitis et al. | 342/792 |
| 4,725,395 | 2/1988 | Gasparaitis et al. | 264/250 |
| 4,890,114 | 12/1989 | Egashira | 343/702 |

*Primary Examiner*—Michael C. Wimer

[57] ABSTRACT

A flexible dipole antenna comprising a flexible center fed coaxial cable (12) having an insulated center conductor, comprising a second radiating element emerging from a first radiating element connected to the outer conductor of the cable (12) and a basket to attach said antenna to a desired apparatus. The antenna also has a first strain relief member (18) coaxially surrounding said cable where said cable emerges from said first radiating element.

1 Claim, 4 Drawing Sheets

ULTRA-FLEXIBLE DIPOLE ANTENNA

FIELD OF THE INVENTION

The present invention relates to the field of antennas in particularly to dipole antennas for use on, for example, hand held radios, telephones, personal computers and the like.

BACKGROUND OF THE INVENTION

Dipole antennas for use on hand held radios, personal computers, telephones, and the like are known. These antennas, especially when used on hand held radios, must be of a rugged design, because portable radios are sometimes exposed to extremely rough handling, including being dropped on the antenna or being held and swung by the antenna. Thus, such antennas must be capable of withstanding repeated flexing with no mechanical or electrical damage ensuing.

U.S. Pat. No. 3,932,873 discloses a center fed dipole antenna system. The system provides a center fed coaxial cable transmission line, a second radiating element connected to the center conductor of the coaxial cable through a feed line connector within the second radiating element, and a first radiator element connected to the outer conductor of the coaxial cable. The first radiator element is connected to the outer conductor through a jumping cable to a braided hollow cylinder which is further connected to a metal coil to create the first radiating element.

The problem to solve with the present invention is to provide an ultra-flexible dipole antenna able to withstand at least 30,000 cycles of bending the antenna at plus or minus ninety degrees.

Another problem to solve with the present invention is to provide a durable ultra-flexible dipole antenna that provides strain relief to cable that is flexed in a flexible antenna, since a center fed cable in an antenna often breaks, when the antenna is flexed, before any of the other components of the antenna break.

SUMMARY OF THE INVENTION

According to the present invention, a center fed ultra-flexible dipole antenna system is provided by a coaxial cable transmission line, a first radiator element, a second radiator element, and at least one strain relief member coaxially surrounding the cable where said cable emerges from the first radiating element and disperses the weight and force of the cable when the antenna is flexed.

Embodiments of the invention will now be described with reference to the accompanying drawings, according to which;

DETAILED DESCRIPTION OF THE PREFERRED EMBODIMENT

Figure 2:
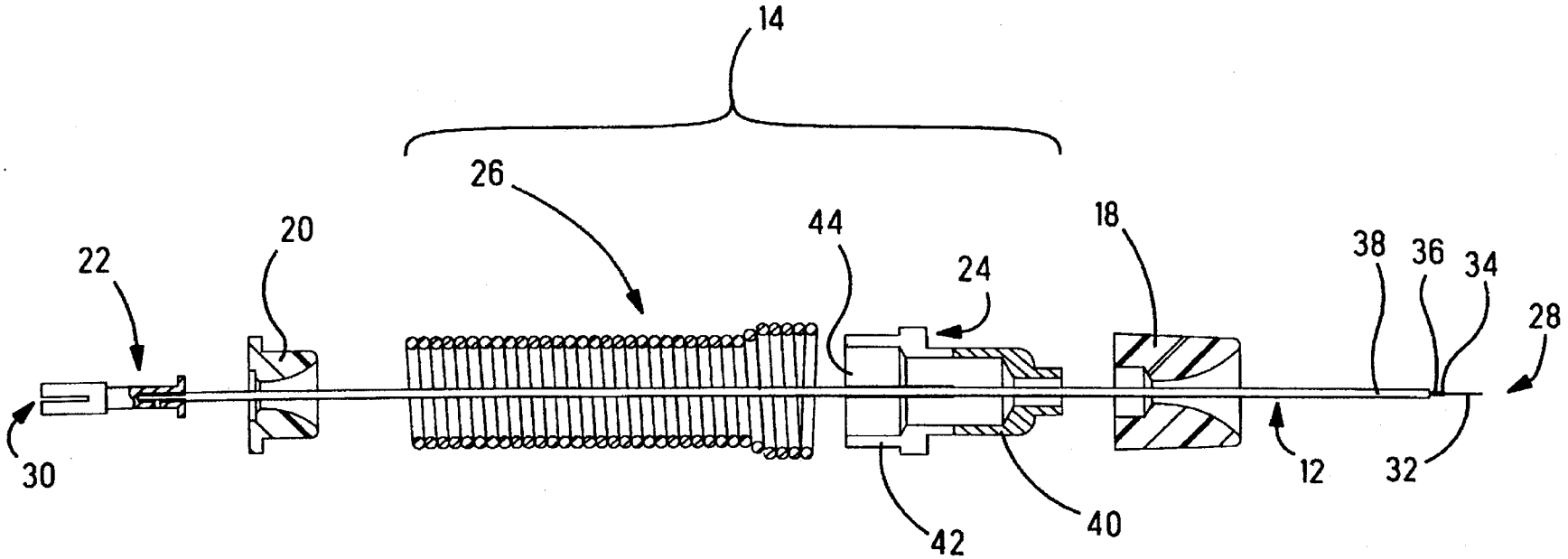
FIG. 2 is an exploded view of an antenna constructed in accordance with the invention.

Referring to FIG. 2, a flexible antenna 10 comprises a flexible center fed coaxial cable transmission line 12, a first radiating element 14, a second radiating element 16, a first strain relief member 18, a second strain relief member 20, and a basket 22. The antenna has two distinct ends, the distal end 28 and the proximal end 30. The proximal end 30 is the end of the antenna that interconnects the antenna to the desired communication device, while the distal end 28 of the antenna is considered to be the part that transmits and receives the desired transmission for the communication device.

The flexible center fed coaxial cable transmission line 12 comprises of a center conductor 32, a dielectric layer 34 coaxially surrounding center conductor 32, a outer conductor 36 coaxially surrounding the dielectric layer 34 and an insulating jacket 38 coaxially surrounding the outer conductor 36.

The center conductor 32 is formed of any suitable conductor, but is preferably of silver coated steel wires. The overall length of the central conductor 32 can be of any suitable length, but is preferably greater than one-half wavelength. The center conductor 32 at the distal end of the antenna is the second radiating element 16 as well known in the antenna art.

The dielectric material 34 is coaxially positioned about central conductor 32 and has a portion L removed from the distal end 28 and the proximal end 30 of the cable. Any suitable dielectric known in the art may be used, such as Teflon.

The outer conductor 36 is formed of any suitable flexible conducting material, such as silver coated copper wire.

The insulating jacket 38 is substantially coextensive with the outer conductor 36 and is formed of any suitable flexible dielectric material appropriate for antenna 10 and its intended operation.

The first radiating element 14 comprises of a metal retention collar 24 and a metal coil 26.

The metal retention collar 24 coaxially surrounds the cable 10 and is formed of any conductive metal, preferably copper. The collar has a design having two portions. The first portion is the upper portion 40 having an inner diameter, at the most distal end of the collar, approximately the size of the outer diameter of the flexible cable 12. While the lower portion 42 has a wider outer diameter permeated by various slots 44 to form a spring finger design which is commonly known in the connector art. The overall length of the collar 24 ranges from 0.25 to 1.0 inches and preferably around 0.4 inches.

The metal coil 26 is a spring coated with a conductive metal, such as silver or gold, to ensure the current goes up and down the radiating element rather than follow the wire. This coil 26 is spring tempered. The metal coil 26 has an inner diameter approximately equal to the outer diameter of the lower portion of the metal retention collar 24. The length of the metal coil 26 has variable lengths dependent upon the desired wavelength of the desired operation.

The first strain relief member 18 and the second strain relief member 20 are comprised of a dielectric material, like Teflon. The strain relief members 18, 20 coaxially surround the cable 12 and have an internal arcuate conical counter sink with a radius, the radius being tangent to the small end of the cone.

The second strain relief member 20 has two distinct outer diameters. The first outer diameter, located toward the distal end of the antenna, is approximately equal to the inner diameter of the metal coil 26. The second outer diameter, located on the proximal end of the antenna, is equal to the outer diameter of the metal coil 26.

In contrast, the first strain relief 18 has one outer diameter. The first strain relief member 18, however, receives the upper portion 40 of the collar 24 at the proximal end 30 of the first strain relief member 18.

The basket 22 operably connects the apparatus and the antenna through a SMA connector which is commonly known in the art.

Antenna 10 further comprises a cover 54 which covers the first radiating element and the second radiating element; and serves to protect the coaxial cable 10 from the elements, excessive wear and tear and the like.

Figure 3:
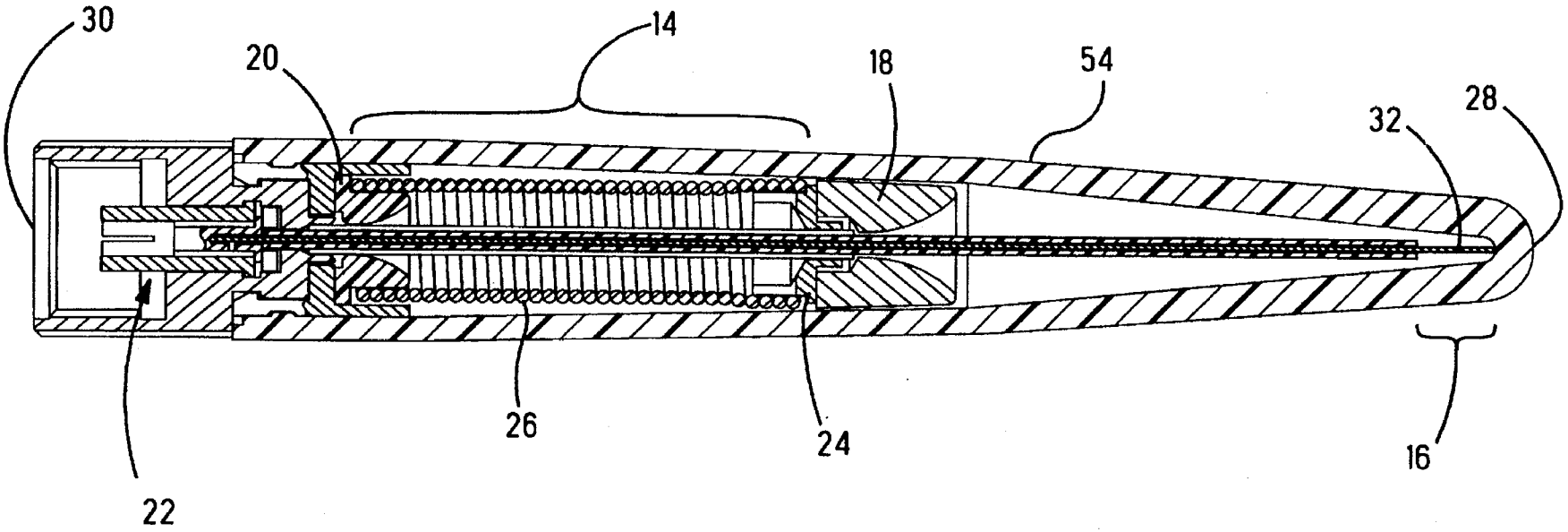
FIG. 3 is a partially cut away view of the antenna of FIG. 2 and a cut away portion of the mating connector of the radio shown in FIG. 1.

Referring to FIGS. 2 and 3, a method for constructing an antenna 10 in accordance with the present invention follows the operation of antenna 10 discussed above and comprises the following steps. The basket 22 is located at the mounting end of the antenna, the proximal end of the antenna. The second strain relief member 20 is attached to the basket by a conventional adhesive. The metal coil 26 is placed into the second strain relief member 20. The metal retention collar 24 is installed in the distal end of the metal coils 20. The cable 10 passes through the basket 22, the metal coil 26 and the collar 24. The metal retention collar 24 is fixedly attached to the cable to create an electrical contact with the collar 24 and the metal coil 26 to form the skirt of the dipole antenna. The first strain relief member 18 receives the upper portion 40 of the collar 24 and is adhesively attached to the upper portion 40.

The cable passed through the collar 24 and first strain relief member 18 is stripped to the center conductor 30 at a desired location to form the second radiator element 16.

The slotted lower portion 42 of the metal retention collar 24 acts as spring loaded fingers and when inserted into the metal coil provide mechanical holding and electrical bonding between the metal coil and the outer conductor of the cable. The spring fingers allow the lower portion of the collar to adjust and compensate for diametrical variations of the metal coil diameter. While the upper portion of the metal retention collar 24 is fixedly attached to the cable by crimping. Moreover, the length of the metal coil 26 can be changed quite readily to ensure the desired apparatus is operating at the desired wavelength.

Thereby, the present ultra-flexible dipole antenna, as shown in FIG. 3, has improved durability since the antenna provides electrical repeatability while withstanding over 30,000 cycles of bending at plus or minus ninety degrees with the strain relief members.

Figure 4:
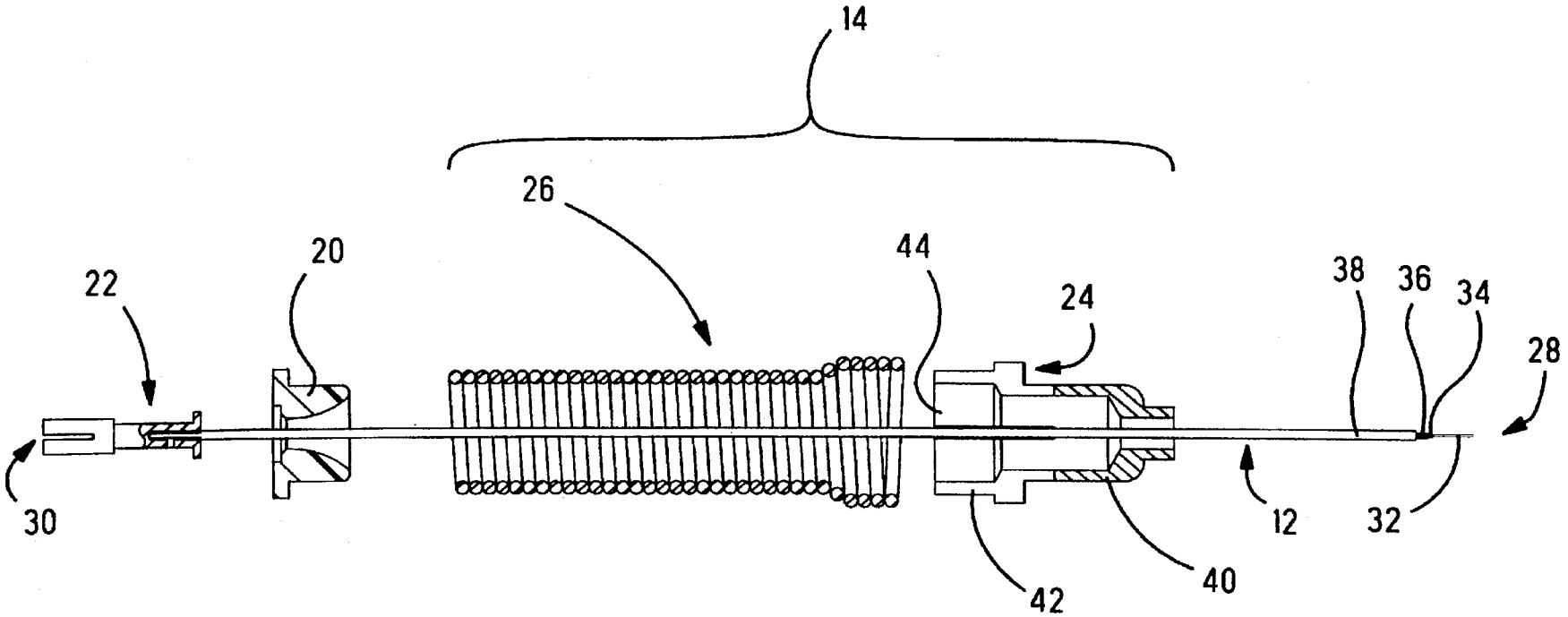
FIG. 4 is an exploded view of an alternative embodiment of an antenna in accordance with the invention.

As shown in FIG. 4, an alternative embodiment of the present invention is disclosed, wherein every component as illustrated in FIGS. 2 and 3 is the same except there is only one strain relief member utilized, the first strain relief member.

Figure 1:
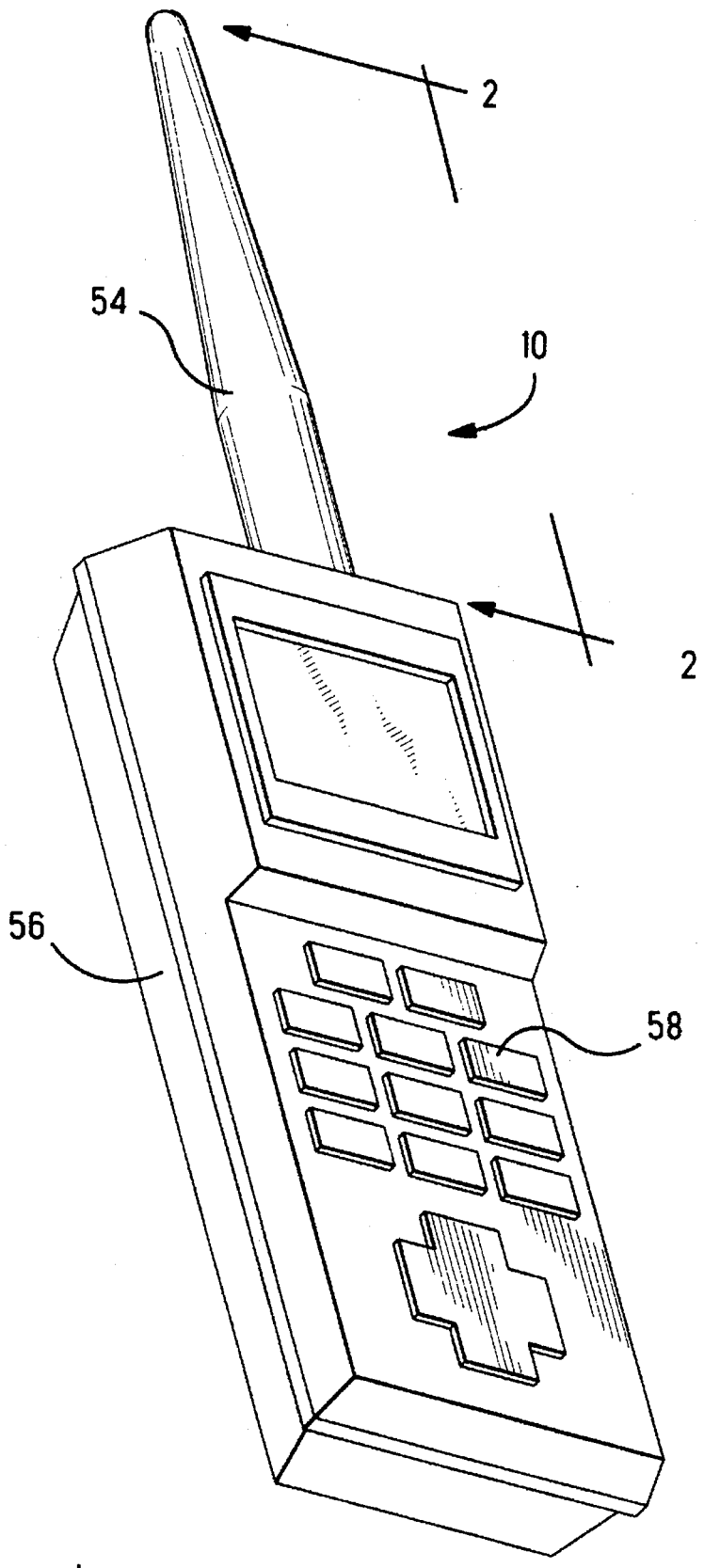
FIG. 1 is a perspective view of a typical hand held two way radio such as could utilize the present invention.

As shown in FIG. 1, antenna 10 of the present invention can be operably connected to any suitable device, such as a hand held two way radio 56, and is operable. Other suitable devices includes personnel computers, telephones and the like.

Radio 12 includes a speaker/microphone grill through which sound travel in both directions. A push to talk switch 58 changes the device from the receive mode of the operation to the transmit mode of the operation as is known in the art. Other controls and indicators vary from one design to the another as needed. Any suitable radio known in the art may be used.

It should be understood that the foregoing is illustrative and not limiting and that obvious modifications may be made by those skilled in the art without departing from the spirit of the invention. Accordingly, reference should be made primarily to the accompanying claims, rather than the foregoing specification, to determine the scope of the invention.

We claim:

1. A flexible dipole antenna, comprising;

a flexible coaxial cable having an insulated center conductor and an outer conductor, a conducting basket connected to the outer conductor, the basket receiving the center conductor therein, a metal coil providing a first antenna radiating element, the coaxial cable extending through said metal coil, the coaxial cable extending beyond said coil to provide another antenna radiating element, a first strain relief member in a first end of the coil and surrounding the coaxial cable, a metal retention collar coaxially surrounding and extending along said cable, an upper portion of said collar fixedly attached to said coaxial cable to create an electrical solderless contact with said outer conductor, a lower portion of said collar having an array of spring fingers coaxially surrounding and extending along said cable, said metal coil being received in a friction fit over the spring fingers of the collar establishing an electrical contact with said collar to form said first radiating element, and said coaxial cable extending from said collar and through a second strain relief member surrounding the coaxial cable, the second strain relief member being mounted on said collar.

* * * * *